United States Patent [19]

Dixon et al.

[11] 4,173,425

[45] Nov. 6, 1979

[54] QUICK COUPLING FOR SIDE SHIFT CYLINDER OF LIFT TRUCK ATTACHMENT

[75] Inventors: Thomas E. Dixon; Jerry L. Chapman, both of Portland, Oreg.

[73] Assignee: Brudi Equipment, Inc., Longview, Wash.

[21] Appl. No.: 896,985

[22] Filed: Apr. 17, 1978

[51] Int. Cl.[2] ..... B66F 9/14

[52] U.S. Cl. ..... 414/667

[58] Field of Search ..... 214/620, 730

[56] References Cited

U.S. PATENT DOCUMENTS 3,819,078 6/1974 Walsh ..... 214/730

FOREIGN PATENT DOCUMENTS 716425 8/1965 Canada ..... 214/730

*Primary Examiner*—Robert G. Sheridan

[57] ABSTRACT

A quick coupling for connecting a side shift cylinder of a carriage attachment to the lift carriage of a lift truck includes a pair of laterally spaced mounting blocks extending between and welded to the upper and lower cross frame members of the lift carriage to provide a mounting space therebetween. A rear portion of a mounting plate extends into the mounting space, and a pull pin extends through aligned openings of the blocks and plate to removably connect the plate to the lift carriage. A forward portion of the plate projects forwardly beyond and overlaps the front faces of the carriage cross frame members and has an opening therethrough which receives a piston rod extension of the side shift cylinder of the attachment. A second pull pin extends through an opening in the leading end portion of the extension to removably connect the side shift cylinder to the mounting plate. Thus the side shift cylinder can be quickly disconnected from the mounting plate, and the mounting plate quickly disconnected from the lift truck carriage to enable the carriage to be used in a conventional manner by pulling the two pins.

8 Claims, 6 Drawing Figures

FIG. 2
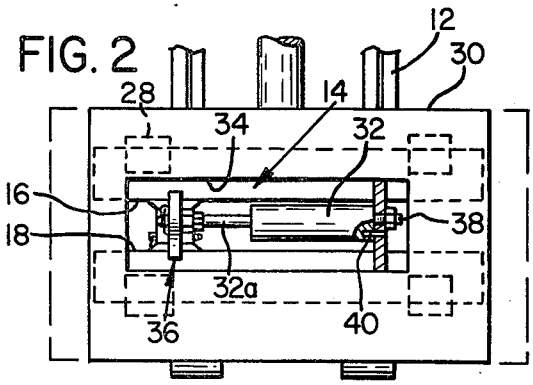
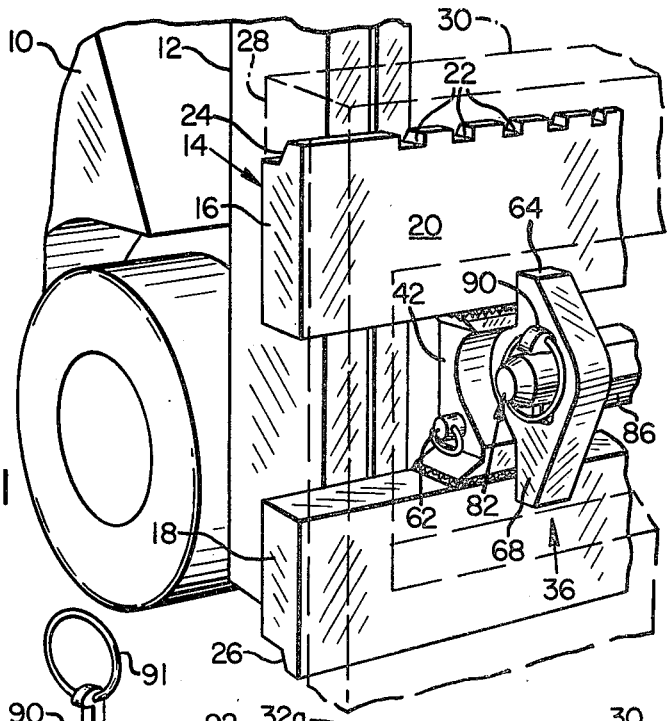
FIG. 1
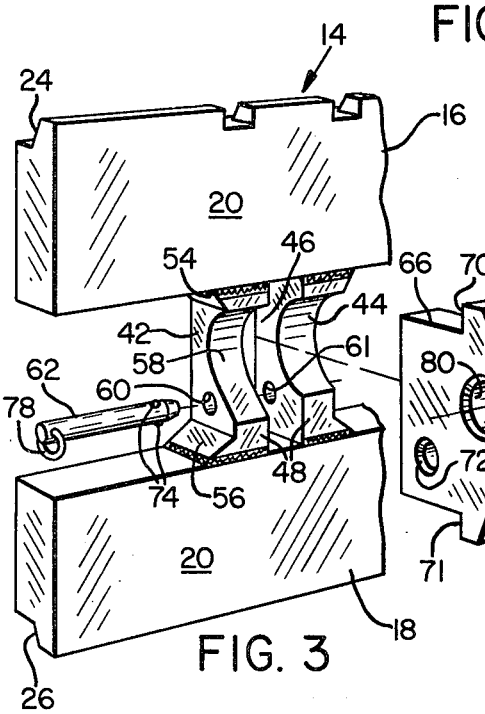
FIG. 3
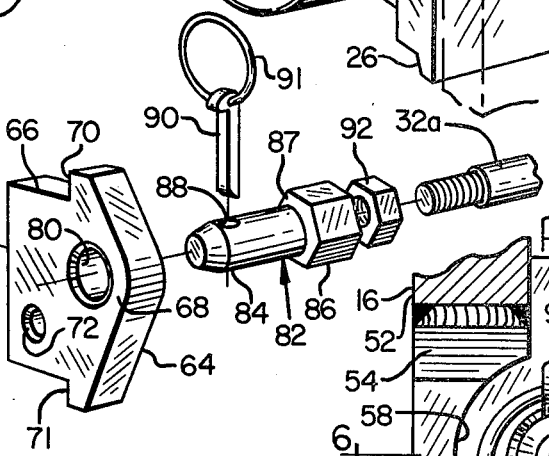
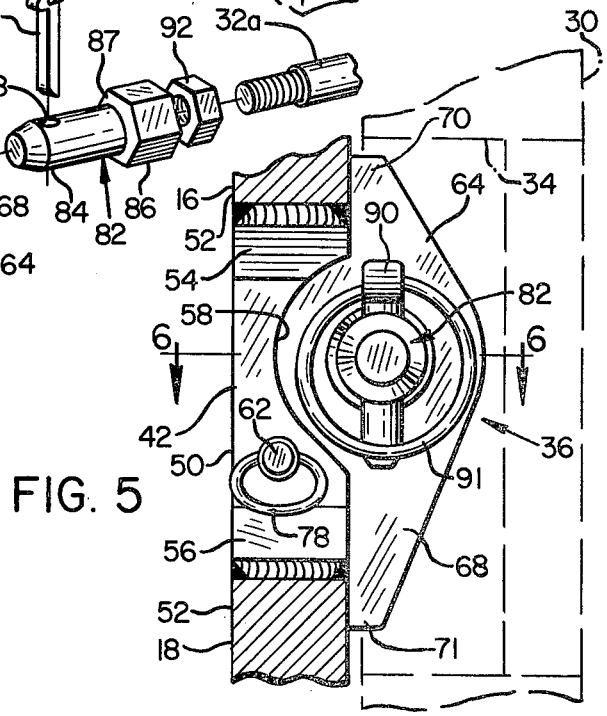
FIG. 5
FIG. 4
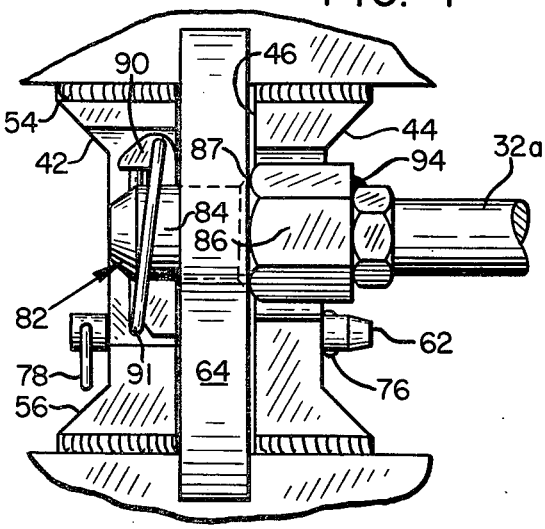
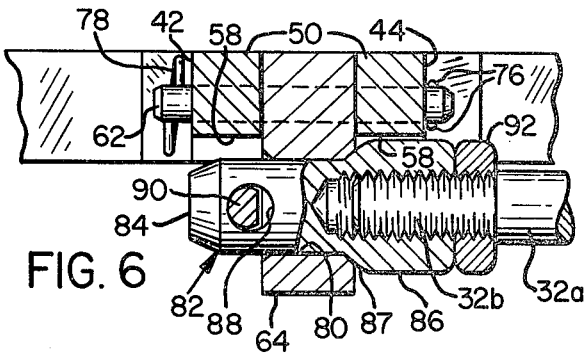
FIG. 6

QUICK COUPLING FOR SIDE SHIFT CYLINDER OF LIFT TRUCK ATTACHMENT

BACKGROUND OF THE INVENTION

1. Field of the Invention

The present invention relates generally to side shift carriage attachments which attach to the conventional lift carriage of a lift truck and more specifically to a quick coupling device for connecting the side shift cylinder of such an attachment to the lift carriage of the truck.

2. Description of the Prior Art

A conventional lift truck front carriage includes a pair of vertically spaced horizontal cross frame members to which conventional lift truck forks can be attached or removed for attachment of various other carriage attachments such as load rotators, side shift carriages and push-all mechanisms.

Side shift attachments are adapted to hook to the upper cross member of a conventional lift carriage and slide sideways therealong under the influence of a side shift cylinder connected at one end to the lift carriage and at the other end to the side shift attachment. Such side shift attachments have presented special problems heretofore because of the need to modify the lift carriage to provide a coupling device for attaching the side shift cylinder to it. Such prior coupling devices have been permanently connected to the lift carriage and have included portions projecting forwardly of the front of the carriage so as to interfere with the use of the lift carriage with other attachments such as lift forks, rotators and the like which require that the frontal portions of the carriage be unobstructed.

To eliminate the need for the foregoing-described use-restricting modification of the lift carriage to accept side shift attachments, so-called "false" carriages have been built, substantially duplicating the lift carriage and attachable thereto. The side shift cylinder coupling device is permanently attached to the false carriage, and the side shift attachment is hooked to the false carriage. The side shift carriage then shifts laterally along the false carriage. When the lift carriage is to be used with other attachments, the false carriage and its side shift attachment are removed therefrom. The disadvantage of this arrangement is that it reduces the load capacity of the lift truck because of the added weight of the false carriage and the increased moment arm of the load with respect to the front wheels of the truck. A further disadvantage of the false carriage arrangement is its increased cost as compared to the previously described arrangement.

From the foregoing it will be apparent that there is a need for a means for connecting the shift cylinder of a side shift attachment to the lift carriage of a lift truck without preventing use of the truck and its carriage with other attachments, without appreciable reduction in the load capacity of the attachment and while minimizing the cost of the connection.

SUMMARY OF THE INVENTION

The present invention is a simple quick coupling device for coupling and uncoupling the side shift cylinder of a side shift attachment from the lift carriage of a lift truck without the use of an intermediate false carriage and without modification of the lift carriage in a way that will interfere with its use with other attachments.

Primary objects of the invention are to provide:

a quick coupling device for quickly connecting and disconnecting a side shift cylinder of a side shift attachment to the lift carriage of a lift truck;

a quick coupling device as aforesaid which, when the side shift attachment is removed from the lift carriage, leaves no projecting obstruction extending forwardly beyond the front faces of the lift carriage cross members, thereby enabling the lift carriage to be used with other attachments;

a quick coupling device as aforesaid which does not require the use of a false carriage between the lift carriage and the side shift attachment and yet enables the lift carriage to accept both side shift attachments and more conventional fork lift and other attachments;

a quick coupling device as aforesaid which is simple to install and operate, of minimal weight, and low in cost;

a quick coupling device as aforesaid which does not reduce the normal load carrying capacity of the side shift attachment.

The quick coupling device of the invention is characterized by a pair of mounting blocks which extend within the space between upper and lower cross frame members of the lift carriage of a lift truck and are affixed thereto in spaced-apart relationship so as to define a mounting space therebetween. A mounting plate has a rearward portion insertable into the mounting space and attachable to the mounting blocks by a first pull pin. The plate has a forward portion which projects forwardly of and overlaps the front faces of the carriage cross frame members. This forward plate portion has an opening therethrough, through which a piston rod extension of the side shift cylinder projects. A second pull pin is inserted through a hole in the leading end portion of the piston rod extension to connect the side shift cylinder to the mounting plate. Thus by pulling the second pull pin the side shift cylinder can be disconnected from the plate; and by pulling the first pull pin the plate can be removed from between the mounting blocks of the lift carriage, thereby leaving the lift carriage suitable for use with other lift truck attachments.

The foregoing and other objects, features and advantages of the invention will become more apparent from the following detailed description, which proceeds with reference to the accompanying drawing.

BRIEF DESCRIPTION OF THE DRAWING

In the drawing:

FIG. 1 is a perspective view of a front end portion of a lift truck including a portion of its lift carriage showing the quick coupling device of the invention attached thereto;

FIG. 2 is a schematic front elevational view of a typical side shift attachment connected to the lift carriage by the quick coupling device of the invention;

FIG. 3 is an exploded perspective view of the quick coupling device of FIG. 1 showing the separable parts of such device;

FIG. 4 is a front elevational view of the quick coupling device of FIG. 1 in its coupled condition;

FIG. 5 is a side elevational view of the quick coupling device of the invention in its coupled condition; and FIG. 6 is a horizontal sectional view taken along the lines 6—6 of FIG. 5.

DETAILED DESCRIPTION OF A PREFERRED EMBODIMENT

With reference to the drawing a conventional lift truck 10, the front end portion of which is shown in FIG. 1, includes the usual lift truck hoist structure including a pair of uprights, one of which is shown at 12, tiltable forwardly and rearwardly in a vertical plane and mounting a lift carriage 14 for vertical movement therealong. The lift carriage includes a pair of vertically spaced upper and lower cross frame members 16, 18, each with a flat generally vertically extending front face 20, with the front faces of such cross frame members lying substantially in a common generally vertical plane.

Typically the upper edge of upper cross frame member 16 is notched at intervals therealong as at 22 for receiving fork lift arm attachments (not shown). Also typically the rear upper edge portion of the upper cross frame member and rear lower edge portion of the lower cross frame member are stepped as at 24, 26 for receiving hook portions of other lift truck attachments, such as the hook portion 28 of a side shift carriage attachment 30 shown in dashed lines in FIGS. 1 and 5 and in full lines in FIG. 2. The side shift attachment itself usually mounts a push-pull mechanism, side-directed fork or grab arms, lift platform or some other load-handling device (not shown). The hooked portion 28 of side shift carriage 30 provides a bearing surface which bears against the top edge surfaces of the upper carriage cross frame member 16 for sliding movement of the side shift carriage on such hook portions along lift carriage 14 under the influence of a side shift cylinder means, namely a fluid-operated extensible side shift cylinder 32, shown in FIG. 2.

Side shift attachment 30 has a center opening 34 through which a coupling means 36 projects from the lift carriage, such coupling means being mounted to the lift carriage between the upper and lower carriage cross members 16, 18. The side shift cylinder 32 is attached at one end of 38 to the frame of the side shift attachment and has a piston rod **32*a* which is connected at its leading end to coupling means 36 of the lift carriage. Thus upon extension of cylinder 32 the side shift attachment shifts to the right in FIG. 2 along lift carriage 14. A roll pin 40 shown in FIG. 2 extends from a side shift carriage member into the stationary end of side shift cylinder 32** to prevent rotation of the cylinder during its extension and retraction.

The present invention is concerned with a specific coupling means 36 whereby the side shift cylinder means of any side shift attachment 30 can be quickly coupled to and uncoupled from the main lift carriage 14 without the use of any intermediate false carriage and without any permanent projection of the coupling means forwardly of the lift carriage cross frame members 16, 18.

In accordance with the present invention, the coupling means 36 comprises a unique quick coupling device. Such device includes a mounting block means comprising a pair of mounting block members 42, 44 which are, as evident from FIG. 3, similar to one another. The two block members extend vertically within the space between the upper and lower carriage cross frame members 16, 18 and are affixed to the inner edge surfaces of such frame members as by welding. Mounting blocks 42, 44 are laterally spaced apart along the cross frame members so that they, together with the cross frame members, define a vertically extending mounting space 46 therebetween. Each mounting block 42, 44 has front face portions 48 which are flush with the front faces 20 of the cross frame members or at least do not project forwardly beyond the front faces of such frame members. Similarly, as shown in FIGS. 5 and 6, the mounting blocks have rear face portions 50 which may lie flush with rear faces 52 of the upper and lower cross frame members.

The mounting blocks 42, 44 also have widened upper and lower base portions 54, 56, respectively, to provide a greater area of welding contact of the blocks with the carriage cross frame members. The front faces of such blocks also include concavely curved recessed surface portions 58 to provide clearance for elements of the side shift cylinder 32 when it is connected to the coupling means, as shown in FIG. 6. The mounting blocks also have horizontally aligned openings 60, 61 extending through their lower portions for receiving a first pull pin 62.

The quick coupling device also includes a mounting plate means comprising a vertically disposed cylinder mounting plate 64 having a rearwardly projecting portion 66 sized to fit snugly within the mounting space 46 between blocks 42, 44 and upper and lower carriage frame members 16, 18. Such plate also includes a forwardly extending lug portion 68 which projects forwardly beyond the front faces 20 of the carriage frame members and has upper and lower lip portions 70, 71 which overlap and abut the front faces 20 when the rearward portion 66 of the plate is inserted fully within mounting space 46.

The rearward portion 66 of plate 64 has an opening 72 therethrough which is aligned horizontally with the openings 60, 61 of the mounting blocks when the rearward portion is inserted within the mounting space. Thus pull pin 62 when inserted through openings 60, 61 of the blocks and aligned opening 72 of the plate removably connects the plate to the blocks and thus to the lift carriage 14, in the manner shown best in FIGS. 4 and 6. The leading end of pull pin 62 carries a spring-loaded ball-type detent 74 to retain the pull pin in place. Pull pin 62 also includes a pull ring 78 at its opposite end for pulling the pin from the blocks after overcoming the resistance of detent 74.

The forward extension portion 68 of mounting plate 64 includes a large transverse opening 80. A cylinder extension means comprising a piston rod extension 82 is threaded to the forward end of piston rod **32*a* of the side shift cylinder. Extension 82 has a leading end portion 84 that extends through opening 80 of the mounting plate in the manner most clearly shown in FIGS. 3, 4 and 6 to project from one side of the plate. Extension 82 also includes an enlarged rear hex nut portion 86 which at its juncture with the leading end portion provides an abutment shoulder at 87 which abuts the opposite side of mounting plate 64 when leading end portion 84** projects through the plate.

Leading end portion 84 of the extension has a through hole 88 which receives a second pull pin 90. Thus when the leading end portion projects through the plate and second pull pin 90 is inserted through hole 88, the side shift cylinder is removably connected to the plate and thus to the lift carriage. Pull pin 90 includes a pull ring 91 to facilitate pulling the pin from piston rod extension 82 to uncouple the cylinder from the lift carriage. Ring 91 is spring-biased so that when pivoted downwardly against the lower end of the pin, it retains itself in such position to prevent dislodging the pin from its hole. Thus, the foregoing elements, including pull pin 90, provide a removable connecting means for connecting extensible portion of the side shift cylinder to the forward portion of the mounting plate.

As shown in FIG. 6, extension 82 is attached to piston rod 32*a* by threading the internally threaded nut portion 86 of the extension onto an externally threaded end portion 32*b* of the piston rod. However, before extension member 82 is threaded onto the end of the piston rod, a lock nut 92 is threaded onto the rod. Nut 92 is tack welded to the rod end to hold it in place. Extension member 82 is threaded onto the end of piston rod 32*a* until its nut portion 86 abuts nut 92. Thereafter, nut 92 may be tack welded to nut portion 86 of the extension member as shown at 94 in FIG. 4 to prevent the extension member and nut 92 from working loose from the end of the piston rod.

Operation

To modify a conventional lift carriage for accepting the coupling of the present invention, the mounting blocks 42, 44 are welded to the upper and lower carriage cross members 16, 18 of conventional carriage 14 so that the front faces 48 of the blocks are flush with the front faces 20 of the cross members, as shown in FIG. 3, and to provide the mounting space 46 therebetween. Blocks 42, 44 thus become a permanent part of the lift carriage assembly 14.

Now to mount a typical side shift carriage 30 to the lift carriage, first the rear portion 66 of mounting plate 64 is inserted into mounting space 46 between the blocks 42, 44 and pinned in place by pull pin 62. With plate 64 pinned to the carriage, the plate is relatively fixed because blocks 42, 44 constrain the plate against lateral movement and carriage cross members 24, 26 constrain the plate against vertical movement, with the lips 70, 71 of the plate adding stability to the connection.

Next, the side shift carriage attachment 30 is attached to the lift carriage by suspending it from its hooks 28 over the top edge of upper carriage cross member 16. The forwardly extending portion 68 of plate 64 extends through center opening 34 of the side shift attachment.

Side shift cylinder 32 is carried by the side shift carriage attachment, and piston rod extension 82 is threaded onto the free end of piston rod 32*a*. Therefore, piston rod extension 82 can now be inserted through opening 80 of plate 64 by extending the cylinder from a retracted condition. Finally, pull pin 90 is inserted through opening 88 of the piston rod extension and its ring 91 pivoted downwardly to lock the side shift cylinder to plate 64 and thus to the lift carriage.

With the side shift attachment suspended from lift carriage 14, and its side shift cylinder 32 connected by the quick coupling 36 to the lift carriage, extension of the side shift cylinder will shift the side shift carriage to the right in FIG. 2, whereas retraction of the cylinder will shift the attachment to the left.

To remove the side shift attachment from the lift carriage, pull pin 90 is pulled from piston rod extension 82, and the cylinder is retracted to remove extension 82 from opening 80 of mounting plate 64. The side shift carriage attachment can now be removed from the lift carriage 14. Next, by removing pull pin 62 from the aligned openings through the mounting blocks and rear of plate 64, the mounting plate is removed forwardly from between the blocks. The front faces of the lift carriage are now clear of any obstruction so that it can be used with more conventional attachments such as lift fork arms attached to the carriage in the usual manner.

Having illustrated and described the principles of our invention by what is presently a preferred embodiment, it should be apparent to those skilled in the art that such embodiment may be modified in arrangement and detail without departing from such principles. Accordingly, we claim as our invention all such modifications as come within the true spirit and scope of the following claims.

I claim:

1. A quick coupling for connecting a side shift cylinder of a lift truck side shift attachment to a vertically movable lift carriage of a lift truck in which the lift carriage includes a pair of vertically spaced horizontal carriage frame members having generally vertically extending front faces, said quick coupling comprising:

a pair of mounting block members extending in the space between and affixed to said carriage frame members in positions such that said block members are laterally spaced apart to define with said frame members a mounting space therebetween, a cylinder mounting plate member having a rearwardly projecting portion sized to fit closely within said mounting space and having a forwardly projecting portion projecting forwardly beyond the front faces of said frame members and overlapping said faces when said rearwardly projecting portion is inserted within said mounting space, a first pull pin means for removably connecting said rearwardly projecting portion of said plate member to said pair of block members when said rearwardly projecting portion is inserted within said mounting space, said forwardly projecting portion of said plate member including means defining an opening therethrough for receiving an extensible end portion of said side shift cylinder, and second pull pin means for removably connecting the extensible end portion of said cylinder to the forwardly projecting portion of said plate member, whereby said side shift cylinder can be quickly connected and disconnected from said plate and said plate can be quickly connected and disconnected from said lift carriage.

2. A device according to claim 1 including means defining generally horizontally aligned openings passing through said pair of block members and said rearwardly projecting portion of the plate member when said rearwardly projecting portion is inserted within said mounting space, said first pull pin means comprising a single pull pin extending through said horizontally aligned openings.

3. A device according to claim 1 wherein said pair of block members have front face portions extending forwardly relative to said carriage no further than said front faces of said carriage frame members.

4. A device according to claim 1 including cylinder extension means attached to the extensible end of said side shift cylinder and passing through said opening in the forwardly projecting portion of said plate member, said extension means including means defining an abutment shoulder for abutting one side of said plate member when a leading end portion of said extension means projects through said plate member, said leading end portion having a hole passing therethrough for receiving said second pull pin means.

5. A device according to claim 3 wherein each said block member has a recessed face portion extending inwardly from said front face portion for receiving portions of a connected side shift cylinder when said cylinder is connected to said plate member.

6. In a lift truck having a hoist at its front end, including a pair of vertically spaced horizontal cross frame members movable vertically along said uprights, a side shiftable carriage attachment for attachment to said lift carriage, said carriage attachment including a side shift cylinder means connected at one end to said carriage attachment and for connection at its opposite end to said lift carriage for side shifting said carriage attachment along said lift carriage, quick coupling means for connecting said side shift cylinder means to said lift carriage comprising, a pair of laterally spaced mounting block members extending in the space between said cross frame members and fixed thereto to define a mounting space therebetween, a mounting plate member with a rear portion insertable into said mounting space, a first pull pin means insertable through said block members and rear portion to removably connect said plate member to said lift carriage, said plate member having a forward portion projecting forwardly of the frontal portion of said cross frame members and including an opening therethrough for receiving an end extension of said side shift cylinder means, and second pull pin means insertable through said end extension for removably connecting said cylinder means to said plate member.

7. A quick coupling for connecting a side shift cylinder of a lift truck side shift attachment to a vertically movable lift carriage of a lift truck in which the lift carriage includes a pair of vertically spaced horizontal carriage frame members, said quick coupling comprising:

block means mounted within the space between said carriage frame members and defining with said frame members a mounting space, mounting plate means having a rear portion insertable within said mounting space and a forward portion projecting forwardly of said carriage frame members, first pull pin means for removably connecting the rear portion of said mounting plate means to said mounting block means, and means including a second pull pin means for removably connecting the forward portion of said mounting plate means to an extensible end portion of said side shift cylinder.

8. A quick coupling for connecting a side shift cylinder of a lift truck side shift attachment to a lift carriage of a lift truck in which the carriage includes carriage frame members defining the front face of the carriage, said quick coupling comprising:

mounting plate means connected to said carriage, said plate means including a projecting lug portion projecting forwardly of the front face of the carriage, said projecting lug portion having a transverse opening extending therethrough, cylinder extension means extending axially outwardly from an extensible end portion of said side shift cylinder and having a leading end portion adapted to pass through said transverse opening of said lug portion, said extension means including means defining an abutment shoulder for abutting one side of said lug portion when said leading end portion projects through said transverse opening and from the opposite side of said lug portion, and said leading end portion having a pin-receiving hole extending therethrough, and pull pin means insertable through said hole for removably connecting said side shift cylinder to said lug portion and thus to said carriage.

* * * * *